US006508668B1

(12) United States Patent
Yamane

(10) Patent No.: US 6,508,668 B1
(45) Date of Patent: Jan. 21, 2003

(54) L-SHAPED COAXIAL CONNECTOR AND TERMINAL FOR THE SAME

(75) Inventor: Masahiro Yamane, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 23 days.

(21) Appl. No.: 09/629,623

(22) Filed: Jul. 31, 2000

(30) Foreign Application Priority Data

Jul. 30, 1999 (JP) ..... 11-216289

(51) Int. Cl.[7] ..... H01R 9/05
(52) U.S. Cl. ..... 439/582
(58) Field of Search ..... 439/63, 578–585, 439/675, 854, 855, 394, 581, 859

(56) References Cited

U.S. PATENT DOCUMENTS 4,590,337 A * 5/1986 Englemore ..... 179/186
5,263,877 A 11/1993 Mitani
5,772,470 A 6/1998 Togashi

FOREIGN PATENT DOCUMENTS

| | | | | |
|---|---|---|---|---|
| EP | 311740 | * | 6/1993 | ..... 439/582 |
| EP | 0739059 | | 10/1996 | |
| JP | 5-152037 | * | 6/1993 | ..... 439/582 |

* cited by examiner

*Primary Examiner*—Brian Sircus
*Assistant Examiner*—J. F. Duverne

(57) ABSTRACT

A connector comprises a dielectric block (20) having an inner cover section (23) having a length smaller than the diameter of a cylindrical section (31) of an outer conductor (30). The height of a connection section (12) of a terminal (10) placed on the top face (25) of the dielectric block (200 is smaller than the diameter of a dielectric member (C2) of a cable. An annular space (2) is formed between the cylindrical section (31) and the body section (21) to receive the contact section of a mating connector. The annular space communicates with the cable accommodation space of the connector, and the cable (C) is exposed to the annular space.

5 Claims, 3 Drawing Sheets

L-SHAPED COAXIAL CONNECTOR AND TERMINAL FOR THE SAME

BACKGROUND OF THE INVENTION

1. Field of the Invention

The present invention relates to L-shaped coaxial connectors and terminals for the same.

2. Description of the Related Art

FIG. 3 shows a conventional connector of this type. A coaxial cable C has a jacket C1, a shield wire C2, a dielectric member C3, and a central conductor C4, which is soldered to a terminal 51 of the connector 50. The terminal 51 has a connection section 52 made by bending a metal piece and a contact section 53. The connection section 52 has a projected portion 52A toward one end and an erected wall 52B at the other end. A slit 52C is provided in the erected wall 52B to position the central conductor C4 in place. The projected portion 52A positions the front end of the central conductor C3. Both the projected portion 52A and the erected wall 52B prevent solder from flowing out of the connection section 52. The contact section 53 consists of a pair of parallel plates extending downwardly from the projected portion 52A.

An insulation block 54 for supporting the terminal 51 has a cylindrical body section 55 and an inner cover section 56. The body section 55 has a central cavity 55A, a flat top face 55B such that the contact section 53 of the terminal 51 is accommodated in the central cavity 55A while the connection section 52 rests on the top face 55B. A shoulder section 57 extends radially from the top of the body section 55 to support the dielectric member 3C of the cable C. The inner cover section 56 and the shoulder section 57 cover the terminal 52.

An outer conductor 58 is made from a metal sheet so as to have a cylindrical section 59 and an outer cover section 60. The cylindrical section 59 accommodates the body section 55 to form an annular space 61 between them. The outer cover section 60 extends laterally from the cylindrical section 59 so as to press down the inner cover section 56 and has a front end crimped around the cable C.

A mating connector 70 has a terminal 71, a dielectric block 72, and an outer conductor 73. The terminal 71 is partially drawn to form a contact projection 71A and has a connection plate 71B. The outer conductor 73 has a cylindrical section 73A, which is inserted into the annular space 61 of the connector 50 to make contact with the cylindrical section 59 while the terminal 71 is fitted into the terminal 53.

However, there has been a demand for a coaxial connector having a small height. The height of the connector in FIG. 3 is equal to the sum of the height of the dielectric body section 55, the diameter of a cable (dielectric member C3), and the thickness of the inner and outer cover sections 56 and 60. The thickness and position of the shoulder section 57 must be considered to reduce the height of the body section 5S. The height of the annular space is limited to the height of the outer conductor which 25 is required for stable plugging operation. Since the connection section 52 of the terminal 51 extends up to the shoulder section 57, it is impossible to reduce the length of the connector beyond this point.

SUMMARY OF THE INVENTION

Accordingly, it is an object of the invention to provide a coaxial connector having small height and length and a terminal for the connector.

According to the invention there is provided an L-shaped coaxial connector comprising a terminal having a connection section to which a central conductor of a cable is connected and a contact section extending at right angles from the connection section for contact with a contact section of a mating connector; a dielectric block for supporting the terminal and having a body section with a central cavity for accommodating the contact section and an inner cover section for pressing the connection section of the terminal placed on a top face of the body section; an outer conductor having a cylindrical section for accommodating the body section and an outer cover section for pressing down the inner cover section.

According to the invention, the inner cover section has a length no more than a diameter of the cylindrical section, and the connection section has a height no more than a diameter of dielectric member of the cable placed on the dielectric block. Since the inner cover section falls within the range of the diameter of the cylindrical section, by lowering the top face of the body section it is possible to reduce the height of the connector. In addition, the cylindrical section does not prevent the inner cover section from compressing the dielectric member of a cable, further reducing the height of the connector.

The dielectric block comprises a shoulder section extending radially from the body section and having a support face for supporting the cable. Since the shoulder section is situated at a position different from that of the inner cover section, the cable is deflected and compressed owing to its flexibility and elasticity so that the shoulder section does not increase the connector height. It is preferred that the top face of the dielectric block is lower than the support face of the shoulder section. It is preferred that the dielectric block comprises a gap between the body section and the shoulder section to facilitate deformation of the cable.

The connection section of the terminal has a U-shaped cross-section with a flat portion to which the central conductor of the cable is soldered and a pair of opposed erected walls, one of which has a slit for receiving the central conductor while the other one is opposed to a front end of the central conductor to not only simplify the manufacture of the terminal but also prevent the solder from adhering undesired parts of the terminal.

DESCRIPTION OF THE PREFERRED EMBODIMENT

Figure 1:
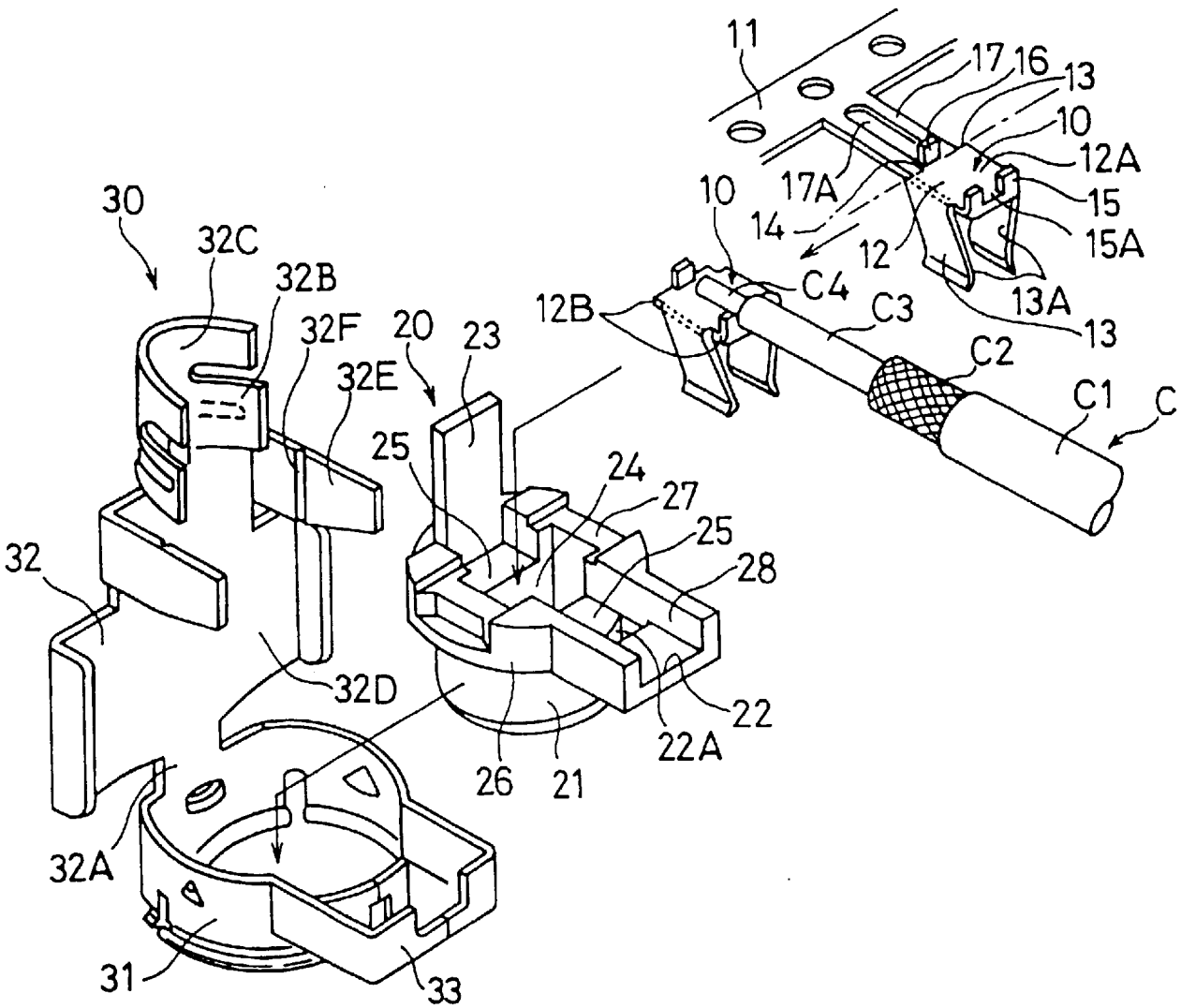
FIG. 1 is an exploded perspective view of a connector according to an embodiment of the invention.

An embodiment of the invention will now be described with reference to FIGS. 1 and 2. An L-shaped coaxial connector prior to assembly according to an embodiment of the invention is shown in FIG. 1. The connector consists of a terminal 10, a dielectric block 20, and an outer conductor 30.

A plurality of terminals 10 are made from a metal strip so as to be coupled with a carrier 11 at regular intervals. Each terminal 10 has a connection section 12 and a contact section 13. The central conductor C4 of a cable C is soldered to the flat portion 12A of the connection section 12 and, then, the terminal is cut off from the carrier 11 at a separation line 14. The connection section 12 has erected walls 15 and 16 at opposite ends 12B while the contact section 13 is comprised of a pair of contact elements extending downwardly from sides between the erected walls 15 and 16. A notch 15A is provided in the erected wall 15 to receive the central conductor C4, and the erected wall abuts against the end face of the dielectric member C3. The erected wall 16 is made from a portion of a window 17A, which is cut out of the linking section 17, so as to be opposed to the front end of the central conductor C4. The lower portions of both the contact elements 13 are curved inwardly to form a throat portion 13A.

The dielectric block 20 is made of a molding of a dielectric material so as to provide a cylindrical body section 21, a shoulder section 22 extending radially from the upper portion of the body section 21, and an inner cover section 23 extending upwardly from a position diametrically opposite to the shoulder section 22.

The body section 21 has a central cavity 24 therein to accommodate the contact section 13 of the terminal 10 and an upper face 25 to support the connection section 12 of the terminal 10. A flange section 26 is provided on the circumferential top face of the body section 21 and a pair of side walls 27 are provided at both sides of the central cavity 24. These side walls, however, are not essential.

A pair of guide walls 28 are provided on both sides of the shoulder section 22 for guiding the inner cover section 23 as hereinafter described. A gap 22A is provided between the shoulder section 22 and the body section 21. The height of the guide walls 28, the side walls 27, and the other portions of the body section is made smaller than the height of the dielectric member C3 of a cable C which is placed on the upper face 25.

The dimensions of the inner cover section 23 are such that when it is bent, the inner cover section 23 is accommodated in the area of the upper face 25. The outer conductor 30 is made from a metal sheet so as to provide a cylindrical section 31 and an outer cover section 32. The cylindrical section 31 has such a diameter as to accommodate the body section 21 to form an annular space between them for receiving the outer conductor of a mating connector therein. An enclosure section 33 extends laterally from the cylindrical section 31 to surround the sides of the shoulder section 22 (and the guide walls 28). The outer cover section 32 has a flat cover portion 32D for covering the tubular section 31 and holding sections 32C and 32B deformed to hold the jacket C1 and the shield wire C2, respectively, when the outer cover 32 is bent toward the cylindrical section 31 at a narrowed base portion 32A. Also, between the holding sections 32C and 32B, and the flat cover section 32D there is provided a pair of tabs 32E which are to be bent at grooves 32F so as to hold the bottom of the shoulder section 22.

The annular space 2 communicates with the cable accommodation section, and the dielectric member is exposed in the annular space 2 so that the front end of the outer conductor of a mating connector can be inserted up to the cable accommodation section. The height of the connector is equal to the sum of the height of the outer conductor required for stable plugging (effective plugging length) and the height of the dielectric member C3 and outer cover section 32. The length of the annular space 2 should be greater than the effective plugging length.

How to assemble such a connector will be described below.

(1) As shown in FIG. 1, the central conductor C4 of a cable C is placed in the notch 15A of the terminal 10 and on the flat portion 12A of the connection section 12 for soldering. The opposite walls 15 and 16 prevent the solder from adhering to the inside of the contact section 13.

(2) The terminal 10 with the cable C is then placed on the dielectric block 20 such that the contact section 13 is accommodated in the central cavity 24 while both the end portions 12B of the connection section 12 and the dielectric member C3 of the cable C are supported by the upper face 25 and the shoulder section 22, respectively.

Figure 2:
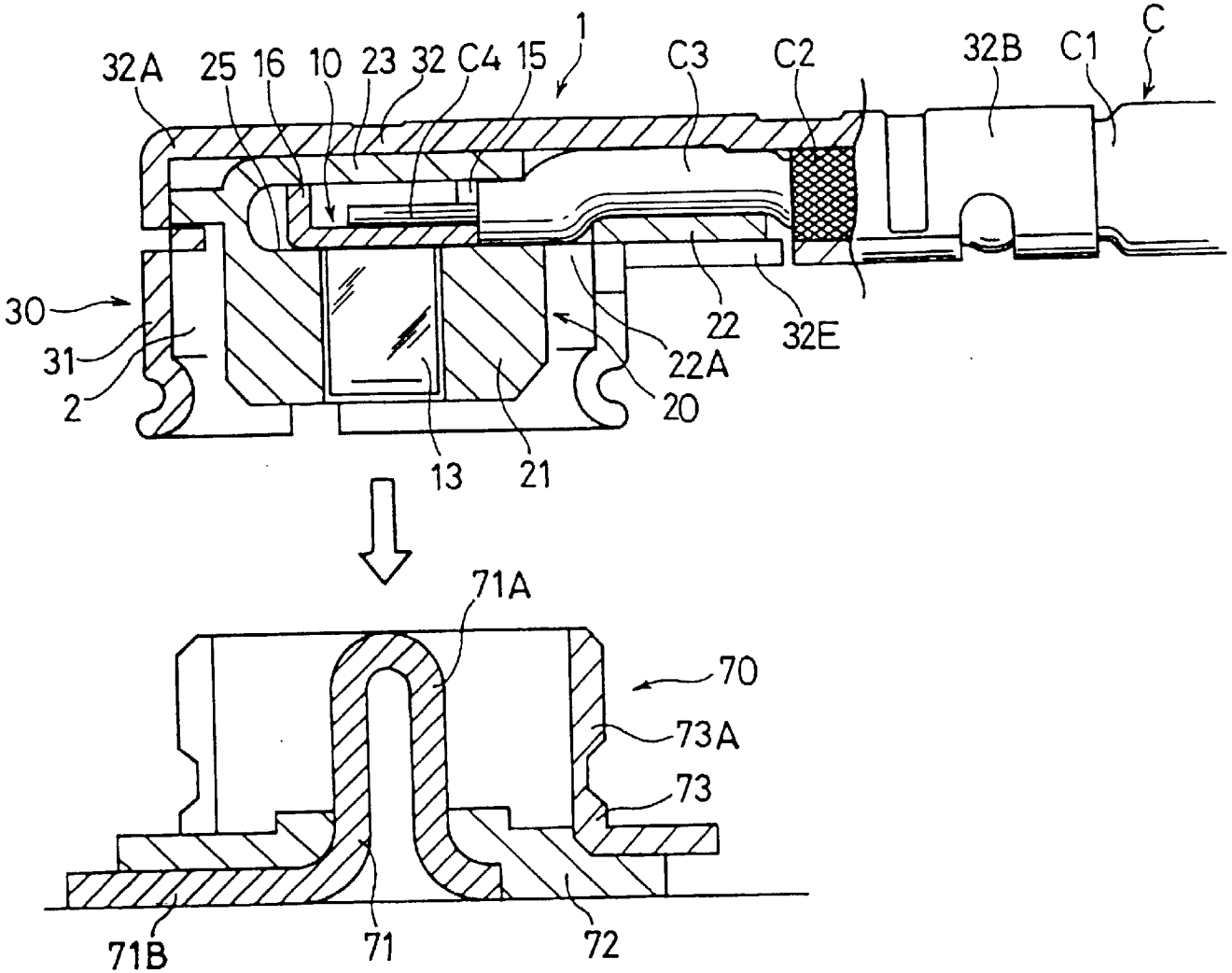
FIG. 2 is a sectional view of the assembled connector.
Figure 3:
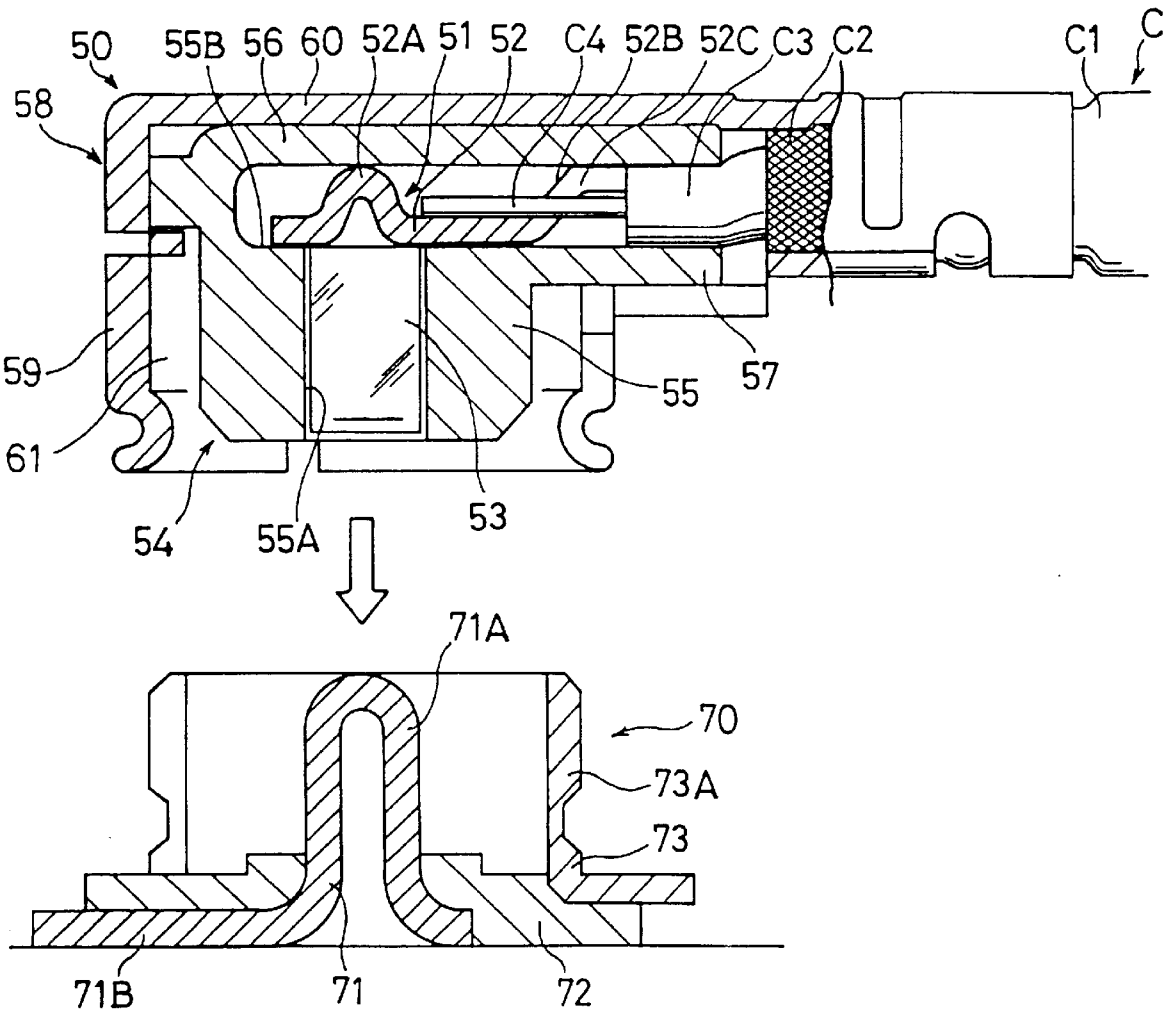
Fig. 3 PRIOR ART
FIG. 3 is a sectional view of a conventional connector.

(3) As shown in FIG. 2, the outer cover section 32 of the outer conductor 30 is bent at right angles at the base portion 32A to press down and bend the inner cover 23 of the dielectric block 20. The holding sections 32B and 32C of the outer conductor 30 are deformed to hold the shield wire C2 and the jacket C1, respectively. Since the inner cover section 23 and the shoulder section 22 are present at different places in the longitudinal direction of the cable C, the dielectric member C3 undergoes simultaneously deflection and compression. Consequently, the height of the inner cover section 23 of the dielectric block 20 is equal to the height of the dielectric member C3 on the shoulder section 22; that is, the connector is lower than the convention one as shown in FIG. 3 by the thickness of the inner cover section. When the cable undergoes the deflection and compression, a portion of the cable escapes into the gap 22A provided between the body section 21 and the shoulder section 22 to thereby facilitate the deformation of the cable.

As has been described above, according to the invention, the annular space communicates with the cable accommodation section so that the cable is exposed in the annular space. Consequently, the front end of an outer conductor of a mating connector can be inserted up to the cable accommodation section so that the height of the connector is equal to the sum of the height of the outer conductor required for stable plugging (effective plugging length) and the height of the cable and the outer cover and smaller than the height of the conventional connector. Since the cable is pressed and held by the shoulder section and the inner cover section at different points in the longitudinal direction so as to subject the cable to deflection and compression, thereby minimizing the height of the connector. Since there is a gap between the body and shoulder sections, it is possible to insert the outer conductor of a mating connector up to the cable accommodation space, thereby minimizing the connector height. Since the connection section is situated inwardly from the shoulder section, the connector length is minimized, making the connector remarkably compact, which allows high-density mounting on electronics equipment.

What is claimed is:

1. An L-shaped coaxial connector comprising:

a terminal having a connection section to which a central conductor of a coaxial cable is connected and a contact section extending at right angles with said connection section for contact with a contact section of a mating connector;

a dielectric block for supporting said terminal, said dielectric block comprising a body section with a central cavity for accommodating said contact section of said terminal and an inner cover section for forming a cable accommodation space above said body section for holding said cable on said body section; and an outer conductor having an outer cover section for pressing down said inner cover section and holding said cable and a cylindrical section for accommodating said body section of said dielectric block to form an annular space between them for receiving an outer conductor of said mating connector, wherein said annular space communicates with said cable accommodation space so that said outer conductor of the mating connector is inserted up to said cable accommodation space.

2. An L-shaped coaxial connector according to claim 1, wherein said dielectric block comprises a shoulder section extending radially from said body section and having a support face for supporting said cable.

3. An L-shaped coaxial connector according to claim 2, wherein said top face of said dielectric block is lower than said support face of said shoulder section.

4. An L-shaped coaxial connector according to claim 2, wherein said dielectric block comprises a gap between said body section and said shoulder section for facilitating deformation of said cable.

5. An L-shaped coaxial connector according to claim 1, wherein said connection section of said terminal has a U-shaped cross-section with a flat portion to which said central conductor of said cable is soldered and a pair of opposed erected walls, one of which has a slit for receiving said central conductor while the other one is opposed to a front end of said central conductor.

* * * * *